US008143540B2

(12) United States Patent
Twellman

(10) Patent No.: US 8,143,540 B2
(45) Date of Patent: Mar. 27, 2012

(54) MULTIFUNCTIONAL FOOT SWITCH

(75) Inventor: Ralf Twellman, Obernkirchen (DE)

(73) Assignee: Steute Schaltgeraete GmbH & Co. KG, Loehne (DE)

( * ) Notice: Subject to any disclaimer, the term of this patent is extended or adjusted under 35 U.S.C. 154(b) by 260 days.

(21) Appl. No.: 12/553,620

(22) Filed: Sep. 3, 2009

(65) Prior Publication Data

US 2010/0089728 A1 Apr. 15, 2010

(30) Foreign Application Priority Data

Oct. 15, 2008 (DE) ..... 20 2008 013 551 U

(51) Int. Cl.
*H01H 3/14* (2006.01)

(52) U.S. Cl. ..... 200/86.5

(58) Field of Classification Search ..... 200/86.5; 606/1, 32, 34, 41, 42, 166, 167, 126, 118, 606/170; 307/119; 74/512, 560–562; 433/98, 433/101, 113; 378/114, 115; 5/613, 616
See application file for complete search history.

(56) References Cited

U.S. PATENT DOCUMENTS

| | | | | | |
|---|---|---|---|---|---|
| 4,558,194 | A * | 12/1985 | Wiblin | 200/61.89 |
| 4,912,388 | A * | 3/1990 | Tanaka et al. | 318/640 |
| 4,916,431 | A * | 4/1990 | Gearey | 340/479 |
| 5,422,521 | A * | 6/1995 | Neer et al. | 307/119 |
| 5,635,777 | A * | 6/1997 | Telymonde et al. | 307/119 |
| 5,712,460 | A * | 1/1998 | Carr et al. | 200/86.5 |
| 6,051,797 | A * | 4/2000 | Meinel | 200/86.5 |
| 6,179,829 | B1 * | 1/2001 | Bisch et al. | 606/1 |
| 6,368,269 | B1 * | 4/2002 | Lane | 600/126 |
| 6,894,236 | B2 * | 5/2005 | Chappuis | 200/86.5 |
| 7,058,998 | B2 * | 6/2006 | Diller et al. | 5/614 |
| 7,470,277 | B2 * | 12/2008 | Finlay et al. | 606/166 |
| 7,877,171 | B2 * | 1/2011 | Gassner | 700/302 |

* cited by examiner

*Primary Examiner* — Michael Friedhofer
(74) *Attorney, Agent, or Firm* — Patricia M. Mathers

(57) ABSTRACT

A multifunctional foot switch is disclosed. The foot switch has two or more actuation elements, arranged such that the operator of the foot switch may select various devices functionally connected to the foot switch merely be repositioning the foot.

13 Claims, 2 Drawing Sheets

MULTIFUNCTIONAL FOOT SWITCH

BACKGROUND INFORMATION

1. Field of the Invention

The invention relates to a foot switch. More particularly, the invention relates to a foot switch having an actuation element and a signal transmission device that generates an output signal.

2. Description of the Prior Art

Generic foot switches are known in the industry. They are used to control medical devices in hospital operating rooms, for example, to control an HF device, a camera, an adjustment device for the operating table, a lighting device, or something similar. In practice, it is not unusual for there to be four or more different foot switches on the floor of the operating room near the surgeon.

The large number of foot switches to be operated by the operating surgeon causes, on the one hand, disadvantageously, a downright cable clutter at the surgeon's feet, and, in addition, the surgeon must change his body position in order to be able to reliably actuate the individual foot switches.

The task of the invention is to improve a generic foot switch in a way that enables a variety of different functions to be achieved by merely changing the position of the foot on one and the same foot switch and thereby to allow control of different devices.

BRIEF SUMMARY OF THE INVENTION

This task is solved by a foot switch that has a housing, at least two actuation elements assembled on the housing, and a signal transmission device that generates an output signal when one actuation element or a combination of such elements are actuated. The actuation elements are arranged on the housing to allow an operator to actuate one or two of the elements simultaneously with one foot. External devices are electronically coupled with one or a combination of two of the actuation elements, so as to be controlled by the foot switch.

In other words, the invention not only allocates a certain function for a certain device to each actuation element, for example, one button or element controlling "brighter light", another "dimmer light", one controlling "higher speed" and another "lower speed", but also enables additional control functions by using combinations of actuation elements. For example, an operator may be able to change the RPM speed by actuating button A and the height of the operating table by actuating button B, but also, for example, turn a light on or off by simultaneously actuating both buttons A and B.

The number of possible switching commands is greatly multiplied when the foot switch has more than two buttons, for example, has three or four buttons. This has the advantage that an adequate number of switching commands for the number of devices used in a particular work area may be executed with a manageable number of different foot positions, i.e., without requiring a large number of different foot positions to execute the individual switching commands, which would overwhelm or confuse the surgeon. Assuming four actuation elements or buttons are provided on the foot switch according to the invention, and that they are arranged approximately in a square or rectangular configuration, then four switching commands may be actuated by individually actuating each of the four buttons. Furthermore, it is possible to actuate two buttons that are arranged "one above the other", i.e., the two right or the two left buttons, whereby the term "one above the other" primarily means that the buttons are spaced a distance apart along the lengthwise dimension of the foot. In the case of a console-like, slanted housing construction, the two buttons that are one above the other may actually be spaced apart vertically. Two sets of diagonally opposing buttons may be actuated by means of two diagonal foot positions. As a result, a total of eight different switching commands may be generated with these four buttons.

If two "adjacent" buttons are also functionally coupled for generating a switching command, then two additional switching commands may be generated with the same four buttons, namely, with simultaneous actuation of the two "upper" or, respectively, the two "lower" buttons. For ergonomic reasons, using both feet would be advantageous for using this combination of buttons. In order to enable the simplest possible actuation of the foot switches with only one foot, however, one may opt to deliberately dispense with these two additional "adjacent" switching positions.

Combining several buttons in the foot switch according to the invention reduces the cable clutter at the surgeon's foot, particularly because one foot switch enables control of several medical devices. Only a single cable leading into the foot switch is required, if the foot switch is attached to a cable at all. Alternatively, the output signals may be transmitted wirelessly, so that no cable at all is required, thus eliminating the risk of tripping that is associated with cable clutter or cables on the floor.

Advantageously, the actuation element may be constructed as a mechanical switch or button, i.e., a switch device that is actuated by moving the device through a certain travel path. In this way, the surgeon receives clear confirmation that switching command has been executed, from the palpable pressure when depressing the button and, possibly, by an acoustical clack sound.

Alternatively and advantageously, the actuation element may be constructed as a sensor, that is, actuation requires no movement of the element. This reduces mechanical wear and tear to the actuation element and allows the flattest possible closed housing surface to be used. Having a flat surface is hygienically advantageous, because the flat surface lends itself more easily to the careful cleaning that is required in medical environments. Suitably flexible housing material or an otherwise flexible covering of the housing may be used over the sensor. Also, conventional contact-free sensors, such as, photoelectric sensors, capacitive sensors, or the like may be used for the foot switch according to the invention. Experts are familiar with the aforementioned sensors and with other standard sensors, which may be suitable for use with the foot switch and they are, therefore, not described in more detail here.

Advantageously, the foot switch according to the invention may be constructed such that two actuation elements or buttons may be coupled functionally in such a way that only simultaneous actuation will generate a switching command in the form of an output signal. In contrast to the possibility mentioned at the beginning, namely, to actuate a button either individually for one signal or jointly with another button for another signal, an output signal is generated only when both buttons are operated simultaneously. This creates an excellent safeguard against inadvertently triggering a switching command, because the actuation of either of the two individual buttons does not in itself trigger the output signal.

The coupling of two switching elements mentioned above may be achieved by constructing a switching element as a pedal, for example. The pedal in its initial resting position i.e., its up position, represents an OFF position and, when moved out of this initial position, i.e., by stepping on the pedal to move it downward, represents the ON position for the switching element. Actuating one of the additional switching elements provided on the pedal when the pedal is in the ON position triggers an output signal.

In an especially space-saving embodiment of the foot switch, the pedal itself may form the housing of the foot switch.

The pedal may be so constructed that, in addition or alternatively to the up/down pedal movement described above, it may be moveable in other directions, either alternatively or additionally, for the purpose of controlling different devices. For example, a pivoting or rotating movement of the pedal about a horizontal axis may actuate the ON and OFF switching, and a translational shift in position of the pedal, either in a horizontal or vertical direction, for example, may serve, depending on the position of the pedal, to allocate the generated switching commands to different specific devices.

Advantageously, a position or device signal may be generated, before the actual switching command is triggered and the corresponding output signal is transmitted to the device that is to be controlled. For this purpose, a position-indicator switch may be provided on the foot switch, which generates a so-called position signal when the user's or surgeon's foot is positioned on the foot switch, indicating that a specific switching command will be generated when one or several buttons are actuated. This position signal may be individualized with regard to both the device to be controlled and the switching command. The position signal may be constructed as an acoustical signal, including, if need be, a voice instruction in plain language.

Alternatively or in addition to this, the position signal may be constructed as an optical signal that, for example, appears on a monitor that is generally already in the surgeon's field of view. The optical signal may be shown in the form of a color code or also as plain text.

The device to be controlled may be selected with particular ease by using voice commands. For this purpose, a microphone may be provided on the foot switch, either in the housing of the foot switch or, to facilitate optional acoustical recording, remotely from the foot switch, but functionally connected to the foot switch. Voice commands serve as acoustical input signals that result in the selection of the device, that is, the next switching command applied to the foot switch transmits an output signal to the selected device. The number of devices that are to be controlled by the foot switch is typically low, for example, four device. Because of this, the cost for voice control for the four devices is low and the control is functionally very reliable.

Advantageously, the foot switch may have a radio device for transmitting the output signals wirelessly to the devices. This effectively eliminates the aforementioned "cable clutter" at the surgeon's feet.

Advantageously, a foot switch constructed according to the invention may also be used to supplement a conventional foot switch. The most frequently actuated device, for example, an HF device, may be actuated using two switching elements on the conventional foot switch to control the HF device. All other, less frequently used devices may then be controlled using the foot switch according to the invention, so that the required number of different actions during actuation of the foot switch according to the proposal is reduced to a minimum, thereby reducing the possibility of mistakes and inadvertent operating errors. The two foot switches, i.e., the foot switch according to the invention and the conventional foot switch, are set up in close proximity to each other so that the surgeon is not required to change body position, at least not in any significant way, in order to operate the two foot switches.

The foot switch according to the invention may advantageously generate digital signals, although the switch may include both analog and digital signal generation. For example, an analog signal may be generated when the foot actuates a certain combination of buttons or actuation elements that are provided for generating an analog signal. A subsequent movement of the foot switch, for example, a translational sliding movement of the foot switch or a pivoting movement of the pedal, then triggers the transmission of the corresponding output signal.

BRIEF DESCRIPTION OF THE DRAWINGS

Embodiments of the innovation are described in greater detail below using purely schematic drawings. This invention should not, however, be construed as limited to the embodiments set forth herein; rather, they are provided so that this disclosure will be complete and will fully convey the scope of the invention to those skilled in the art.

DETAILED DESCRIPTION OF THE INVENTION

Figure 1:
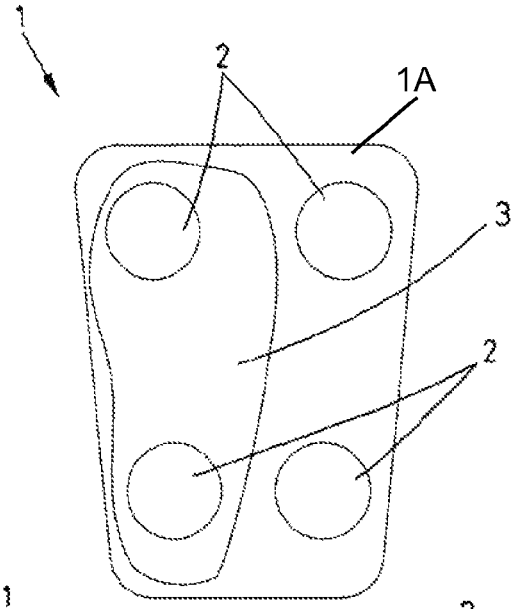
FIG. 1 illustrates a foot switch according to the invention, having four buttons, and showing a first foot position.
Figure 2:
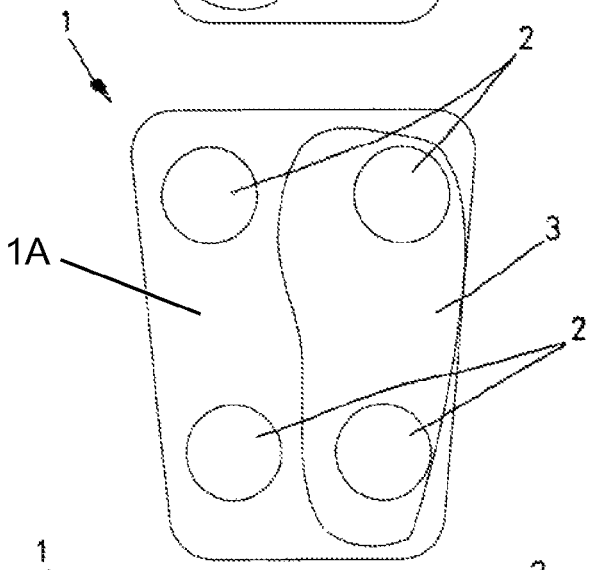
FIG. 2 is an illustration of the foot switch of FIG. 1, showing the foot in a second position.
Figure 3:
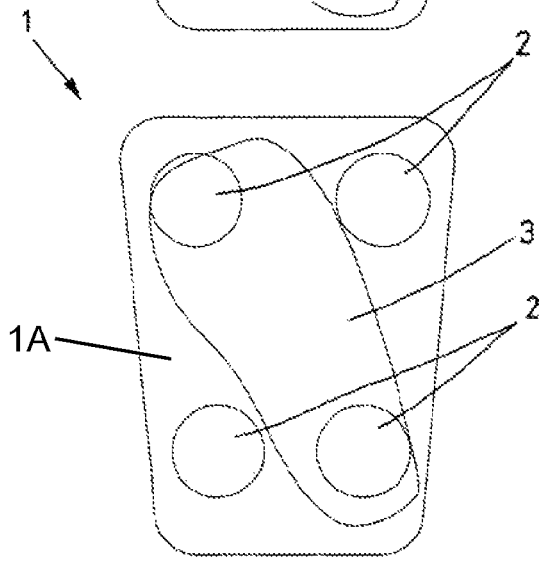
FIG. 3 is an illustration of the foot switch of FIG. 1, showing the foot in a third position.

FIGS. 1-3 show a foot switch 1 according to the invention, which has several actuation elements or buttons 2 arranged on foot switch housing or plate 1A. The reference designation 1 shall refer to all embodiments of the foot switch according to the invention. These figures show a foot 3 taking various positions on the foot switch 1, in order to actuate various combinations of actuation elements 2.

FIG. 1 shows two left actuation elements 2 being actuated, with the two elements 2 being positioned vertically one above the other. In this context "vertical" denotes a direction that runs the longitudinal direction of the foot 3 and, in the plane of the present drawing, from the bottom to the top margin of the image.

The simultaneous actuation of two actuation elements 2 reduces the possibility of inadvertently selecting a wrong function or device when operating the foot switch 1, because accidental contact with only one of the actuation elements 2 will not generate an output signal. The depicted foot switch 1, however, may also be constructed in a way that enables one to generate an output signal by using only one actuation element 2.

Provision is made for an initial so-called "position" signal to be generated, which optically and/or acoustically alerts the user of the foot switch 1 as to which actuation element 2 or combination of elements has just been actuated, before the output signal associated with the element or elements 2 is generated. Thus, the operator of the foot switch 1 has the opportunity to correct a false device or function selection, before false output signals are transmitted to the connected medical devices.

FIG. 3 shows an switching position in which two diagonally opposing actuation elements 2 are being actuated simultaneously. Similarly, the two other actuation elements 2, which are not being actuated in FIG. 3, may also be simultaneously actuated by a diagonal foot position, but for a different device or function.

Figure 4:
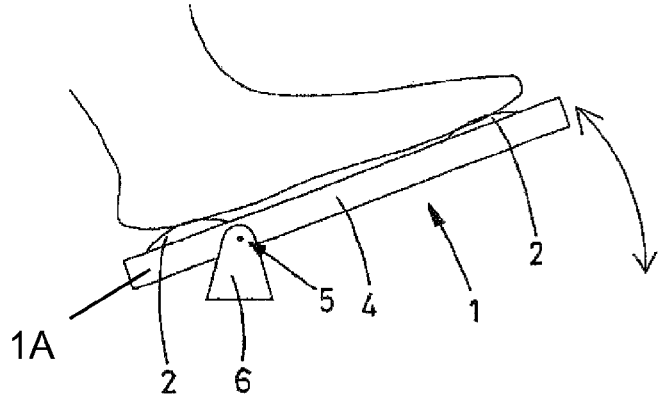
FIG. 4 is an side elevational view of the foot switch constructed as a foot pedal.

FIG. 4 shows a foot switch 1 that is constructed as a pedal 4, whereby the pedal 4 is rotatable about a horizontal pivot axis 5 and, for this purpose, is mounted on a bearing block 6.

Figure 5:
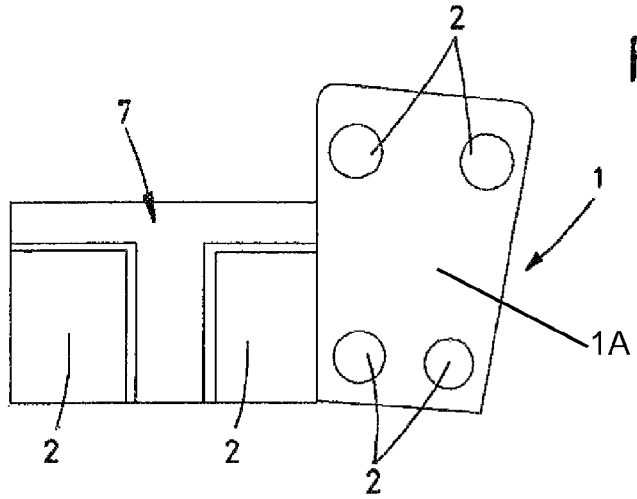
FIG. 5 is a top plan view of a first combination foot switch that includes the foot switch according to the invention and a conventional foot switch.
Figure 6:
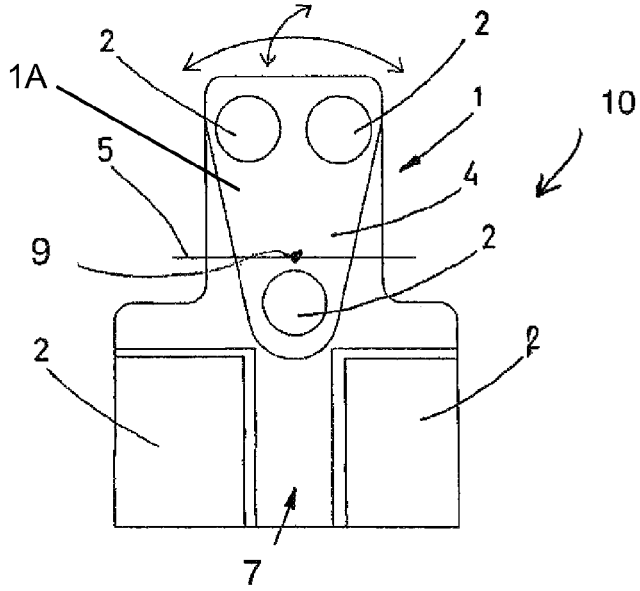
FIG. 6 is a top plan view of a second combination foot switch that includes the foot switch according to the invention and a conventional foot switch.

FIG. 5 and FIG. 6 each show a combination of two foot switches 1 and 7. In each figure, the "multifunctional foot switch" 1 according to the invention is shown, combined with a conventional foot switch 7. The foot switch 1 has several actuation elements 2, whereby at least one of the elements 2 may be used to trigger different output signals when actuated, for example, singly or together with another element 2, or together with one of several other buttons 2. The conventional foot switch 7 has two actuation elements 2, whereby each of these two actuation elements 2 is used to trigger only one specific output signal.

In the embodiment according to FIG. 5, the two foot switches 1 and 7 are arranged next to each other, for example, by having the foot switch 1 according to the proposal retrofitted and mounted laterally on the existing foot switch 7. The individual actuation elements 2 are therefore positioned in close proximity to each other, so that actuation of all elements 2 is ergonomically advantageous. The conventional foot switch 7 is hereby preferably used for the most frequently operated device, and the additionally provided foot switch 1 according to the invention is used for additional switching commands. The combination of the two foot switches 1 and 7 enables execution of all switching tasks that are typically needed in the operating room.

A well-organized arrangement of the foot switches reduces even further the space needed for a combination of foot switches and improves the ergonomic construction. FIG. 6 shows such an improved combination foot switch 10, in which, additionally, the foot switch 1 according to the invention is not retrofitted, but is instead incorporated as a standard part into a combination-foot switch. Three actuation elements 2 are provided on the pedal 4. The individual or simultaneous operation of these elements triggers switching commands and sends out output signals, whereby the ability the move the position of the pedal 4 allows the output signals to be allocated to specific devices that are functionally controlled by the foot switch 1. In other words, certain positions of the pedal 4 are allocated to specific devices. For example, similar to the embodiment of FIG. 4, a horizontal pivot axis 5 allows the pedal 4 to be pivoted or rotated about the pivot axis 5. The pedal 4 may also be rotated about a perpendicular axis 9, shown perpendicular to the plane of the drawing sheet.

Finally, the pedal 4 may be mounted on the combination foot switch 10 so as to be slidable on the horizontal plane and in the aforementioned "vertical" direction or, perpendicular to this, in a "horizontal" direction. When the number of devices to which the foot switch 1 is limited to only several devices, then these different positions of the pedal 4 may also be used to trigger certain switching commands, to control functions, rather than to actuate specific devices. A sliding movement of the pedal 4 in the horizontal direction toward the right may function, for example, to cause a motor to run at a higher speed or a lighting device to become brighter, whereas the horizontal movement of the pedal 4 in the opposite direction may cause the motor to run at a correspondingly lower speed or the light to become dimmer.

It is understood that the embodiments described herein are merely illustrative of the present invention. Variations in the construction of the multifunctional foot switch may be contemplated by one skilled in the art without limiting the intended scope of the invention herein disclosed and as defined by the following claims.

What is claimed is:

1. A foot switch comprising:

a foot switch plate;

at least three actuation elements that are provided on the switch foot plate; and a signal transmission device that generates an output signal that is transmitted to a device;

wherein the at least three actuation elements are arranged such that an operator, with one foot, selectively actuates a single actuation element or simultaneously a combination of two of the at least three actuation elements, thereby selecting a particular output signal to be transmitted to a particular device.

2. The foot switch according to claim 1, wherein at least one of the three actuation elements is constructed as a button.

3. The foot switch according to claim 1, wherein at least one of the three actuation elements is constructed as a sensor.

4. The foot switch of claim 1, wherein the at least three actuation elements are three in number and selective actuation of the single actuation element or the combination of actuation elements provides for generation of a total of six particular output signals.

5. The foot switch of claim 1, further comprising an alert signal switch;

wherein different alert signals are allocated to the different output signals that are to be generated, and wherein the alert signal switch triggers transmission of an alert signal before a corresponding output signal is generated, so as to allow the operator to correct a falsely selected output signal.

6. The foot switch claim 1 further comprising:

a microphone and an electronic switch that is functionally connected to the microphone and designated as voice recognition, wherein the electronic switch is constructed such that individual ones of the at least three devices are controllable, depending upon an acoustical input signal received by the microphone.

7. The foot switch of claim 1, further comprising a radio device that is constructed for wireless transmission of the output signals.

8. The foot switch of claim 1, wherein the foot switch plate is constructed as a movable pedal.

9. A system of foot switches comprising:

a first foot switch having a housing that includes at least three actuation elements, and a signal transmission device that generates an output signal;

wherein the at least three actuation elements are arranged on the first foot switch such that two actuation elements are simultaneously actuatable with one foot; and wherein the first foot switch has connections for at least three devices that are to be controlled by the first foot switch, such that, various individual devices of the at least three devices are controllable by selectively actuating a first actuation element, a second actuation element, and a combination of the first actuation element and the second actuation element; and a second foot switch that is arranged in close proximity to the first foot switch, wherein the second foot switch is constructed as a conventional foot switch that includes one or more actuation elements, each of the actuation elements generating only one output signal at a time.

10. A foot switch comprising:

a foot switch plate;

at least three actuation elements arranged on the foot switch plate; and a signal transmission device;

wherein a first actuation element is constructed as a pedal, the pedal being movable between two positions;

wherein the at least three actuation elements are arranged such that an operator, with one foot, selectively actuates a single actuation element or simultaneously a combination of two of the at least three actuation elements, thereby selecting a particular output signal to be transmitted by the signal transmission device.

11. The foot switch according to claim 10, wherein the pedal forms the foot switch plate of the foot switch and the at least three actuation elements are arranged on the pedal.

12. The foot switch according claim 10, at least two devices are controllable by selectively moving the pedal between the at least two positions.

13. The foot switch of claim 10, wherein the at least three actuation elements are three in number and selective actuation of a single one of the actuation element and any combination of two of the actuation elements provides for generation of a total of six particular output signals.

* * * * *